US009860666B2

(12) United States Patent
Laitinen

(10) Patent No.: US 9,860,666 B2
(45) Date of Patent: Jan. 2, 2018

(54) BINAURAL AUDIO REPRODUCTION

(71) Applicant: Nokia Technologies Oy, Espoo (FI)

(72) Inventor: Mikko-Ville Laitinen, Helsinki (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/743,144

(22) Filed: Jun. 18, 2015

(65) Prior Publication Data

US 2016/0373877 A1 Dec. 22, 2016

(51) Int. Cl.
*H04S 7/00* (2006.01)

(52) U.S. Cl.
CPC ..... *H04S 7/304* (2013.01); *H04S 2420/01* (2013.01)

(58) Field of Classification Search
CPC ..... H04S 2420/01; H04S 7/304
USPC ..... 381/309, 310; 704/504
See application file for complete search history.

(56) References Cited

U.S. PATENT DOCUMENTS

| | | | | |
|---|---|---|---|---|
| 6,738,479 | B1 | 5/2004 | Sibbald et al. | 381/17 |
| 8,867,750 | B2 | 10/2014 | Brown | 381/17 |
| 2009/0046864 | A1 | 2/2009 | Mahabub et al. | |
| 2009/0252356 | A1 | 10/2009 | Goodwin et al. | |
| 2011/0299707 | A1 | 12/2011 | Meyer | |
| 2016/0180858 | A1* | 6/2016 | Breebaart | G10L 19/008 704/504 |

FOREIGN PATENT DOCUMENTS

| | | | |
|---|---|---|---|
| EP | 2304975 | B1 | 8/2014 |
| EP | 2335428 | B1 | 1/2015 |
| WO | WO-2004/049759 | A1 | 6/2004 |
| WO | WO-2007080211 | A1 | 7/2007 |
| WO | WO-2007112756 | A2 | 10/2007 |
| WO | WO-2014036121 | A1 | 3/2014 |
| WO | WO-2015/048551 | A2 | 4/2015 |

OTHER PUBLICATIONS

Wenzel, Elizabeth M., et al., "Perceptual Consequences of Interpolating Head-Related Transfer Functions During Spatial Synthesis", IEEE Workshop on Source, 1993, 4 pgs.
Christensen, Flemming, et al., "Interpolating Between Head-Related Transfer Functions Measured with Low-Directional Resolution", AES Convention, Sep. 1999, 25 pgs.

(Continued)

*Primary Examiner* — Md S Elahee
(74) *Attorney, Agent, or Firm* — Harrington & Smith

(57) ABSTRACT

A method including providing an input audio signal in a first path and applying an interpolated head-related transfer function (HRTF) pair based upon a direction to generate direction dependent first left and right signals in the first path; providing the input audio signal in a second path, where the second path includes a plurality of filters and a respective amplifier for each filter, where the amplifiers are configured to be adjusted based upon the direction, and applying to an output from each of the filters a respective head-related transfer function (HRTF) pair to generate direction dependent second left and right signals for each filter in the second path; and combining the generated left signals to form a left output signal for a sound reproduction, and combining the generated right signals to form a right output signal for the sound reproduction.

22 Claims, 5 Drawing Sheets

(56) References Cited

OTHER PUBLICATIONS

Kendall, G.; "A 3D Sound Primer: Directional Hearing and Stereo Reproduction"; Computer Music Journal, vol. 19, No. 4 (Winter 1995); 1995 Massachusetts Institute of Technology; pp. 23-46.
Menzer, F.; "Binaural Audio Signal Processing Using Interaural Coherence Matching"; Swiss Federal Institute of Technology Lausanne; Apr. 2010; whole document (155 pages).
Laitinen, M. et al.; "Binaural Reproduction for Directional Audio Coding"; IEEE Workshop on Applications of Signal Processing to Audio and Acoustics: Oct. 18-21, 2009; New Paltz, New York, USA; pp. 337-340.
Laitinen, M.; "Binaural Reproduction for Directional Audio Coding"; Helsiinki University of Technology, Department of Signal Processing and Acoustics; Espoo, Finland; May 26, 2008; whole document (74 pages).
Catic, J. et al.; "The effect of interaural-level-difference fluctuations on the externalization of sound"; Journal of the Acoustical Society of America 134 (2); Aug. 2013; pp. 1232-1241.
Begault, D. et al.; "Direct Comparison of the Impact of Head Tracking, Reverberation, and Individualized Head-Related Transfer Functions on the Spatial Perception of a Virtual Speech Source"; Journal of the Audio Engineering Society, vol. 49, No. 10; Oct. 2001; pp. 904-916.

* cited by examiner

BINAURAL AUDIO REPRODUCTION

BACKGROUND

Technical Field

The exemplary and non-limiting embodiments relate generally to spatial sound reproduction and, more particularly, to use of decorrelators and head-related transfer functions.

Brief Description of Prior Developments

Spatial sound reproduction is known, such as which uses multi-channel loudspeaker setups, and such as which uses binaural playback with headphones.

SUMMARY

The following summary is merely intended to be exemplary. The summary is not intended to limit the scope of the claims.

In accordance with one aspect, an example method comprises providing an input audio signal in a first path and applying an interpolated head-related transfer function (HRTF) pair based upon a direction to generate direction dependent first left and right signals in the first path; providing the input audio signal in a second path, where the second path comprises a plurality of filters and a respective adjustable amplifier for each filter, where the amplifiers are configured to be adjusted based upon the direction, and applying to an output from each of the filters a respective head-related transfer function (HRTF) pair to generate direction dependent second left and right signals for each filter in the second path; and combining the generated left signals from the first and second paths to form a left output signal for a sound reproduction, and combining the generated right signals from the first and second paths to form a right output signal for the sound reproduction.

In accordance with another aspect, an example embodiment is provided in an apparatus comprising a first audio signal path comprising an interpolated head-related transfer function (HRTF) pair applied to an input audio signal based upon a direction configured to generate direction dependent first left and right signals in the first path; a second audio signal path comprising a plurality of: an adjustable amplifier configured to be adjusted based upon the direction; a filter for each adjustable amplifier, and a respective head-related transfer function (HRTF) pair applied to an output from the filter, where the second path is configured to generate direction dependent second left and right signals for each filter in the second path, and where the apparatus is configured to combine the generated left signals from the first and second paths to form a left output signal for a sound reproduction, and to combine the generated right signals from the first and second paths to form a right output signal for the sound reproduction.

In accordance with another aspect, an example embodiment is provided in a non-transitory program storage device readable by a machine, tangibly embodying a program of instructions executable by the machine for performing operations, the operations comprising: controlling, at least partially, a first audio signal path for an input audio signal comprising applying an interpolated head-related transfer function (HRTF) pair based upon a direction to generate direction dependent first left and right signals in the first path; controlling, at least partially, a second audio signal path for the same input audio signal, where the second audio signal path comprises adjustable amplifiers configured to be set based upon the direction, applying outputs from the amplifiers to respective filters for each of the amplifiers and applying to an output from each of the filters a respective head-related transfer function (HRTF) pair to generate direction dependent second left and right signals for each filter in the second path; and combining the generated left signals from the first and second paths to form a left output signal for a sound reproduction, and combining the generated right signals from the first and second paths to form a right output signal for the sound reproduction.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
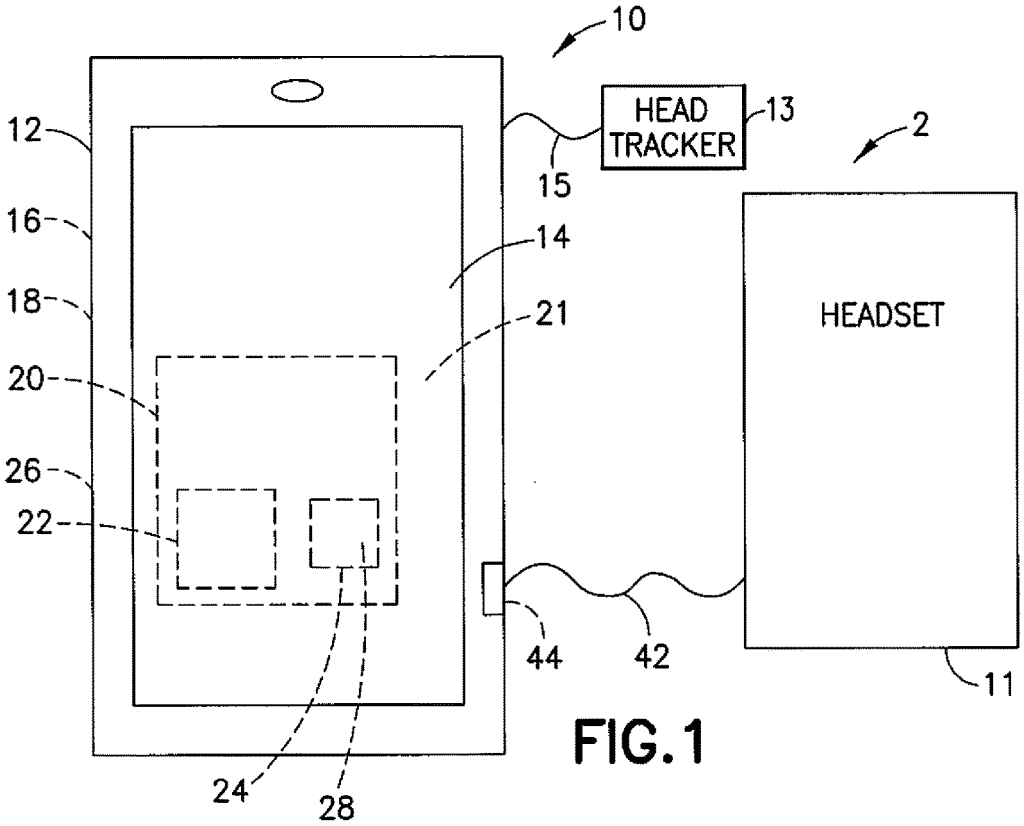
FIG. 1 is a diagram illustrating an example apparatus.

Referring to FIG. 1, there is shown a front view of an apparatus 2 incorporating features of an example embodiment. Although the features will be described with reference to the example embodiments shown in the drawings, it should be understood that features can be embodied in many alternate forms of embodiments. In addition, any suitable size, shape or type of elements or materials could be used.

The apparatus 2 includes a device 10 and a headset 11. The device 10 may be a hand-held communications device which includes a telephone application, such as a smart phone for example. The device 10 may also comprise other applications including, for example, an Internet browser application, camera application, video recorder application, music player and recorder application, email application, navigation application, gaming application, and/or any other suitable electronic device application. The device 10, in this example embodiment, comprises a housing 12, a display 14, a receiver 16, a transmitter 18, a rechargeable battery 26, and a controller 20. The controller may comprise at least one processor 22, at least one memory 24, and software 28 in the memory 24. However, all of these features are not necessary to implement the features described below. In an alternate example, the device 10 may be a home entertainment system, a computer such as used for gaming for example, or any suitable electronic device suitable to reproduce sound for example.

The display 14 in this example may be a touch screen display which functions as both a display screen and as a user input. However, features described herein may be used in a display which does not have a touch, user input feature. The user interface may also include a keypad (not shown). The electronic circuitry inside the housing 12 may comprise a printed wiring board (PWB) 21 having components such as the controller 20 thereon. The circuitry may include a sound transducer provided as a microphone and a sound transducer provided as a speaker and/or earpiece. The receiver 16 and transmitter 18 form a primary communications system to allow the apparatus 10 to communicate with a wireless telephone system, such as a mobile telephone base station for example.

The apparatus 10 is connected to a head tracker by a link 15. The link 15 may be wired and/or wireless. The head tracker 13 is configured to track the position of a user's head. In an alternate example, the head tracker 13 may be incorporated into the apparatus 10 and perhaps at least partially incorporated into the headset 11. Information from the head tracker 13 may be used to provide the direction of arrival 56 described below.

Figure 2:
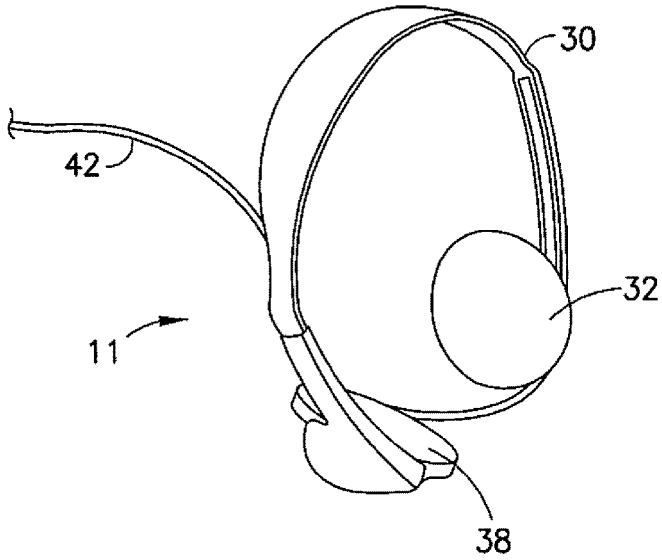
FIG. 2 is a perspective view of an example of a headset of the apparatus shown in FIG. 1.

Referring also to FIG. 2, the headset 11 generally comprises a frame 30, a left speaker 32, and a right speaker 34. The frame 30 is sized and shaped to support the headset on a user's head. Please note that this is merely an example. As another example, an alternative could be an in-ear headset or ear buds. The headset 11 is connected to the device 10 by an electrical cord 42. The connection may be a removable connection, such as with a removable plug 44 for example. In an alternate example, a wireless connection between the headset and the device may be provided.

A feature as described herein is to be able to produce a perception of an auditory object in a desired direction and distance. The sound processed with features as described herein may be reproduced using the headset 11. Features as described herein may use a normal binaural rendering engine together with a specific decorrelator engine. The binaural rendering engine may be used to produce the perception of direction. The decorrelator engine, consisting of several static decorrelators convolved with static head-related transfer functions (HRTF), may be used to produce the perception of distance. Features may be provided with as little as two decorrelators. Any suitable number of decorrelators may be used, such as between 4-20 for example. Using more than about 20 might not be practical, since it increases computational complexity, and does not improve the quality. However, there is no upper bound for the number of the decorrelators. The decorrelators may be any suitable filters which are configured to provide a decorrelator functionality. Each of the filters may be at least one of: a decorrelator, and a filter configured to provide a decorrelator functionality wherein a respective signal is produced before applying the respective HRTF pair.

Head-related transfer functions (HRTF) are transfer functions measured in an anechoic chamber with the sound source at the desired direction and the microphones inside the ears. There are a number of different ways to interpolate HRTFs. Creating interpolated HRTF filter pairs has been widely studied. For example, descriptions may be found in "Perceptual consequences of interpolating head-related transfer functions during spatial synthesis," by Elizabeth M. Wenzel and Scott H. Foster, in Proceedings of the IEEE Workshop on Applications of Signal Processing to Audio and Acoustics, New Paltz, N.Y., USA, pp. 102-105, October 1993; and "Interpolating between head-related transfer functions measured with low directional resolution," by Flemming Christensen, Henrik Møller, Pauli Minnaar, Jan Plogsties, and Søren Krarup Olesen, in Proceedings of the 107th AES Convention, New York, N.Y., USA, September 1999. For example, three HRTF pairs closest to the target direction may be selected from a HRTF database, and a weighted average of them may be computed separately for the left and the right ears. In addition, the corresponding impulse responses can be time-aligned before the averaging, and the inter-aural time differences (ITD) can be added after the averaging.

With features as described herein, the input signal may be convolved with these transfer functions, and the transfer functions are updated dynamically according to the head rotation of the user/listener. For example, if the auditory object is supposed to be in the front, and the listener turns her/his head to −30 degrees, the auditory object is updated to +30 degrees; thus remaining in the same position in the world coordinate system. As described below, a signal convolved with several static decorrelators convolved with static HRTFs causes ILD fluctuation, and the ILD fluctuation causes the externalized binaural sound. When the two engines are mixed in a suitable proportion, the result may provide a perception of an externalized auditory object in a desired direction.

Unlike past proposed use of decorrelators, and especially reverberators, for enhancing externalization, features as described herein propose use of a static decorrelation engine comprising a plurality of static decorrelators. The input signal may be routed to each decorrelator after multiplication with a certain direction-dependent gain. The gain may be selected based on how close the relative direction of the auditory object is to the direction of the static decorrelator. As a result, interpolation artifacts, when rotating a listener's head, are avoided while still having some directionality for the decorrelated content; which was found to improve the quality. In addition, unlike proposed reverbetor-based methods, features as described herein do not cause a prominent perception of added reverberation.

Figure 3:
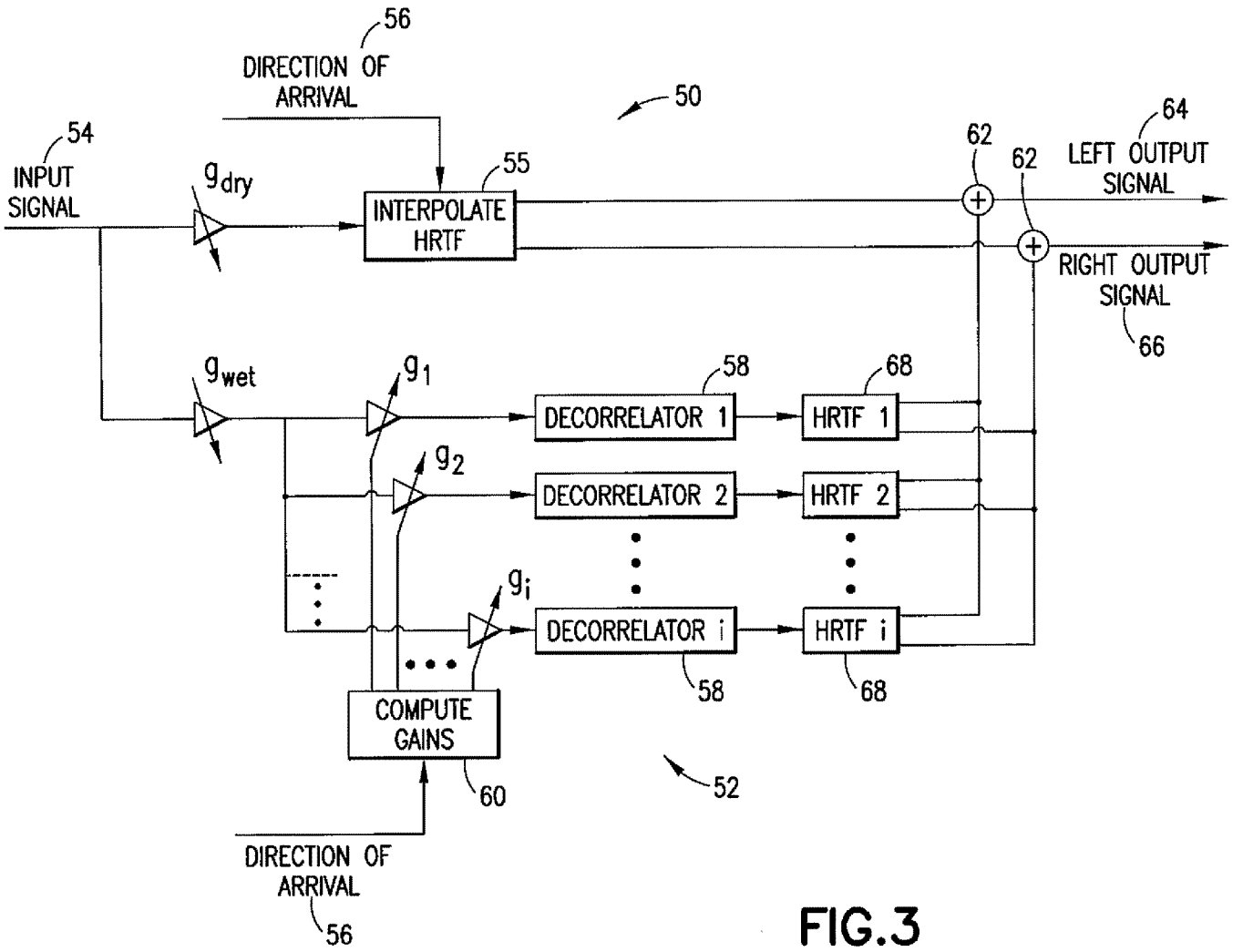
FIG. 3 is a diagram illustrating some of the functional components of the apparatus shown in FIG. 1.

Referring also to FIG. 3, a block diagram of an example embodiment is shown. The circuitry of this example is on the printed wiring board 21 of the device 10. However, in alternate example embodiments one or more of the components might be on the headset 11. In the example shown the components form a binaural rendering engine 50 and a decorrelator engine 52. An input audio signal 54 may be provided from a suitable source such as, for example, a sound recording stored in the memory 24, or from signals received by the receiver 16 by a wireless transmission. Please note that these are only examples. With features as described herein, any suitable signals can be used as an input, such as arbitrary signals for example. For example, input signals which could be used with features as described herein can include mono recordings of guitar, or speech, or any signals. In addition to the input audio signal, a direction of arrival indication of the sound is supplied to the two engines 50, 52 as indicated by 56. Thus, the inputs comprise one mono audio signal 54 and the relative direction of arrival 56.

In this example the path for the binaural rendering engine 50 includes a variable amplifier $g_{dry}$, and the path for the decorrelator engine 52 includes a variable amplifier $g_{wet}$. The gain provided by these amplifiers for the "dry" and the "wet" paths can be selected based on how "much" externalization is desired. Basically, this affects the perceived distance of the auditory object. In practice, it has been noticed that good values include $g_{dry}=0.92$ and $g_{wet}=0.18$ for example. Please note that these are merely examples and should not be considered as limiting. As can be seen from the above, gain of the amplifiers can also be smaller than 1. Thus, "amplifying" is actually "attenuation" in that case.

The relative direction of arrival may be determined based on the desired direction in the world coordinate system, and the orientation of the head. The upper path of the diagram is a simply normal binaural rendering. A set of head-related transfer functions (HRTF) may be provided in a database in the memory 24, and the resulting HRTF may be interpolated based on the desired direction. Thus, for the first path provided by the engine 50, the input audio signal 54 may be convolved with the interpolated HRTF as indicated by 55. An HRTF is a transfer function that represents the measurement for one ear only (i.e. either the right ear only or the left ear only). The directionality requires both the right ear HRTF and the left ear HRTF. Thus, for a given direction, one requires an HRTF pair, and after interpolation 55 there are two paths. The direction of arrival 56 is introduced by the HRTF pair, and the HRTF filter comprises the respective pair.

The lower path in the block diagram of FIG. 3 shows the other engine 52 which forms a second different path from the first path of the first engine 50. The input audio signal 54 is routed to a plurality of decorrelators 58. The decorrelated signals are convolved with pre-determined HRTFs 68, which may be selected to cover the whole sphere around the listener. In one example, a suitable number of the decorrelator paths is twelve (12). However, this is merely an example. More or less than twelve decorrelators 58 may be provided, such as between about 6 and 20 for example.

Each decorrelator path has an adjustable amplifier $g_1$, $g_2$, . . . $g_i$, located before its respective decorrelator 58. Gain of the amplifiers may be smaller than 1. Thus, amplifying is actually attenuation in that case. The amplifiers $g_i$ are adjusted as computed by 60 which is based upon the direction of arrival signal 56. The gain $g_i$ for each decorrelator path may be selected based on the direction of the source as follows $$g_i=0.5+0.5(S_xD_{x,i}+S_yD_{y,i}+S_zD_{z,i})$$

where $S=[S_x\ S_y\ S_z]$ is the direction vector of the source and $D_i=[D_{x,i}\ D_{y,i}\ D_{z,i}]$ is the direction vector of the HRTF in the decorrelator path i. The decorrelators 58 can basically be any kind of decorrelator (e.g., different delays at different frequency bands).

In the example shown in FIG. 3, one input goes in and one output comes out from each decorrelator. These decorrelators may be designed in a nested structure so that one can have one block comprising all decorrelators and within this one block the same functionality can be provided. One could pre-convolve the decorrelator and the HRTF, and sum them together, after weighting them, based on the computed input gains ($g_1$-$g_N$). Then the input signal may be convolved with this filter. The output should be identical to the implementation shown in FIG. 3. In the case of a single source, FIG. 3 may be computationally the most efficient implementation.

In one example embodiment a pre-delay in the beginning of the decorrelator may be provided. Adding a pre-delay in the beginning of the decorrelator may be useful. The reason for the pre-delay is to mitigate the effect of the decorrelated signals to the perceived direction. This delay may be at least 2 ms for example. This is approximately the time instant when the summing localization ends and the precedence effect starts. As a result, the directional cues provided by the "dry" path dominate the perceived direction. The delay can be also less than 2 ms. The optimal quality may be obtained using the value of at least 2 ms, but the method could be used with smaller values. For the first 2 ms after the first wavefront, the directions of the secondary wavefronts (whether they are real reflections or reproduced with loudspeakers or headphones or anything) affect the perceived direction. After 2 ms, the directions of the secondary wavefronts do not affect the perceived direction, they merely affect the perceived spaciousness and the apparent width of the sources. Hence, in order to minimally the perceived affect to the directions of the sources, the decorrelated paths may include this 2 ms delay. However, as noted above the method may work also with shorter delays. Nevertheless, adding the pre-delay is not required, especially since the decorrelators typically have some inherent delay, although it is potentially useful. For example, even a delay of 0 ms could be used because the decorrelators have some inherent delay The decorrelators are essentially all pass filters, so they must have an impulse response longer than just one impulse). Thus, adding some additional delay, such as 2 ms, may be provided, but it is not required.

It should be noted that the number of decorrelator paths affects the suitable value for $g_{wet}$. In the end of the processing, the signals of the dry path and the wet paths are summed together as indicated by 62, yielding one signal 64 for left channel and one signal 66 for right channel. These signals can be reproduced using the speakers 32, 34 of the headphones 11. Furthermore, the ratio between $g_{dry}$ and $g_{wet}$ affects the perceived distance. Thus, controlling the amplifiers $g_{dry}$ and $g_{wet}$ can be used for controlling the perceived distance.

Features as described herein may be used in the field of spatial sound reproduction. In this field, the aim is to reproduce the perception of spatial aspects of a sound field. These include the direction, the distance, and the size of the sound source, as well as properties of the surrounding physical space.

Human hearing perceives the spatial aspects using the two ears of the listener. So, if a suitable sound pressure signal is reproduced at the eardrums, the perception of spatial aspects should be as desired. Headphones are typically used for reproducing the sound pressure at the ears.

One would expect that recording the sound field using microphones inside the ears would provide good spatial cues. However, it does not allow the listener to rotate the head while listening. The lack of dynamic spatial cues is known to cause front-back confusions and lack of externalization. In addition, for example in virtual-reality applications, the listener has to be able to look around while having the perceived sound field static in the world coordinate system; which using microphones inside the ears does not allow.

In theory, the binaural playback should produce a perception of an auditory object that is at the desired direction and distance. However, conventionally this does not typically happen. The direction of the auditory object might be correct, but it is often perceived to be very close to the head or even inside the head (called internalization). This is contrary to the aim of a realistic, externalized, auditory object.

For head-related transfer functions (HRTF), in theory the direction and the distance should match the measured ones. However, conventionally this does not happen, and instead, there is a perceived lack of externalization (the sound sources are perceived to be very close or inside the head). The reason for this lack of externalization is that the human hearing uses direct-to-reverberant ratio (D/R ratio) as a cue for distance. Obviously, anechoic responses do not have these cues. As HRTF rendering cannot, in conventional practice, reproduce the sound pressure fully accurately to the ears, human hearing typically interprets these sound sources as internalized or very close sources.

One solution to problems with HRTFs is to instead use binaural room impulse responses (BRIR). These are measured in a same way as HRTFs, but in a room. They provide externalization due to the presence of the D/R-ratio cues. However, there are some drawbacks. They always add the perception of reverberation of the room where they were measured; which is not typically desired. Second, the responses might be long which causes computational complexity. Third, the perceived distance is locked to the distance where the responses where measured. If multiple distances are desired, all responses have to be measured at multiple distances, which can be time consuming, and the size of the database of the responses grows fast. Lastly, the interpolation (when the listener rotates the head) between different responses can cause artifacts, such as changes in the timbre and a perception of frequency-changing comb filter. An alternative to BRIRs is to simulate the reflections and render them with HRTFs. However, the same problems are largely present (the perception of added reverberation, interpolation artifacts, and computational complexity). Methods of adding reverberation to the HRTFs, and to use head tracking, suffer from the problems that were identified. Features as described herein may be used to avoid these problems.

The fluctuation of ILD is a process inside the auditory system. With features as described herein, audio signals may be created which cause this fluctuation of the ILDs. The fluctuation of inter-aural level differences (ILD) may be used for the perception of externalized binaural sound. This ILD fluctuation is the reason why reverberation helps in externalization. Thus, it can also be assumed that reverberation itself is not necessarily needed for externalization; it is simply enough to cause proper ILD fluctuation. With features as described herein, a method may be provided that can create this ILD fluctuation without unwanted side effects.

Similar problems are present in other fields of spatial audio, such as in systems capturing and reproducing sound fields. These systems also use decorrelation and reverberation strategies for improving externalization with binaural rendering. For example, the binaural implementation for directional audio coding (DirAC) uses decorrelators. However, the scope of these two techniques is different. With features as described herein, arbitrary mono signals may be positioned to desired directions and distances, whereas binaural DirAC attempts to recreate the perception of the sound field in the recording position using recorded B-format signals. Binaural DirAC also performs time-frequency analysis, extracts the "diffuse" (or "reverberant") components from the captured signals, and applies decorrelation on the extracted diffuse components. Features as described herein do not require such processing.

Figure 4:
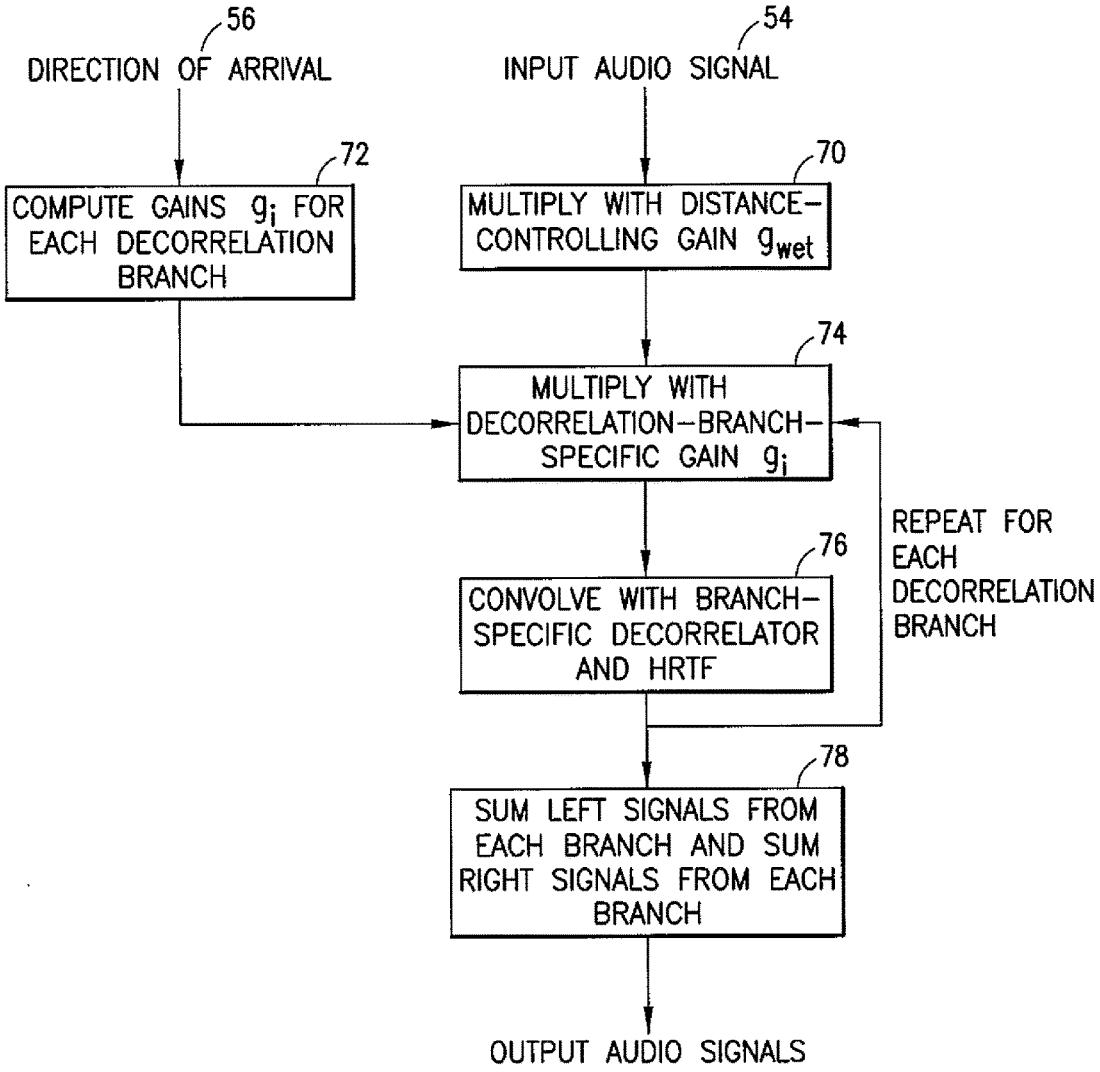
FIG. 4 is a diagram illustrating an example method.

Referring also to FIG. 4, a diagram of an example method is shown. FIG. 4 generally corresponds to the "wet" signal path shown in FIG. 3. The input audio signal 54 and the direction of arrival 56 are provided. The input audio signal 54 is multiplied with a distance controlling gain $g_{wet}$ as indicated by block 70. Gains $g_i$ are computed for each decorrelation branch as indicated by block 72. As indicated by block 74, the output from multiplication 70 is multiplied with a decorrelation-branch-specific gain $g_i$, and convolved with a branch-specific decorrelator 58 and HRTF 68. The output from the branches are then summed as indicted by 78 and 62 in FIG. 3.

The method improves the typical binaural rendering by providing externalization which is much better, repeatable, and adjustably correct than conventional methods. In addition, this is achieved without a prominent perception of added reverberation. Importantly, the method was found not to cause any interpolation artifacts for the decorrelated signal path. The interpolation artifacts are avoided because the decorrelated signals are statically reproduced from the same directions. Only the gain for each decorrelator is changed, and this may be changed smoothly. As the decorrelator outputs are mutually incoherent, changing the levels of the input signal for them does not cause significant timbre changes; preventing interpolation artifacts for the wet signal path.

In addition, the method is relatively efficient computationally. Only the decorrelators are somewhat heavy to compute. Moreover, if the method is a part of a spatial sound processing engine that uses decorrelators and HRTFs anyway, the processing is computationally very efficient; only a few multiplications and additions are required.

Although the perception of added reverberation might not be fully avoided, especially if the source is desired to be very far away, audio sources which are very far are rarely completely anechoic. In addition, the level of perceived reverberation is assumed to be significantly lower than with typical solutions.

In virtual-reality (VR) applications, the sound is typically reproduced using headphones. The reason for this is that the video is reproduced using head-mounted displays. As the video is seen by only one individual at a time, it makes sense that also the audio is heard by only that individual. In addition, as VR content may have visual and auditory content all around the subject, loudspeaker reproduction would require setups with large number of loudspeakers. Thus, headphones are the logical option for spatial-sound reproduction in such applications.

Spatial audio is often delivered in multi-channel format (such as 5.1 or 7.1 audio for example). Thus, there is a need for a system that can render these signals using headphones so that they are perceived as if they were reproduced in a good listening room with a corresponding loudspeaker setup. Such a system can be implemented using the features as described herein. The input to the system can include the multi-channel audio signals, the corresponding loudspeaker directions, and the head-orientation information. The head orientation is typically obtained automatically from a head-mounted display. The loudspeaker setup is often available in the metadata of the audio file, or it can be pre-defined.

Each audio signal of the multi-channel file may be positioned to the direction determined by the loudspeaker setup. Moreover, when the subject rotates her/his head, these directions may be rotated accordingly; in order to keep them in the same positions in the world coordinate system. The auditory objects may be positioned to suitable distances. When these features of auditory reproduction are combined with head-tracked stereoscopic visual reproduction, the result is very natural perception of the reproduced world around. The output of the system is an audio signal for each channel of the headphones. These two signals can be reproduced with normal headphones. Other use cases can easily be derived for the VR context. For example, the features could be used for positioning auditory objects to arbitrary directions and distances in real time. The directions and the distances could be obtained from the VR rendering engine.

With features as described herein, single monophonic sources may be processed separately. Obviously, these monophonic sources may realize a multi-channel signal when put together, but it is not required in the method. They can be fully independent sources. This is unlike conventional processes where either multi-channel signals (e.g., 5.1 or stereo) are processed, or somehow combined processed signals are processed.

Features as described herein also proposes to enhance externalization by applying fixed decorrelators. This may be used to avoid any interpolation artifacts when the system is combined with head tracking (which requires to rotate auditory objects as a function head orientation). This is unlike conventional methods where there is no specific processing of signals for head tracking; the directions of the sources are simply rotated. Thus, conventionally all components of the processing require rotation, and this rotation needs interpolation, which potentially causes artifacts. With features as described herein, these interpolation artifacts are avoided by not rotating decorrelated components and, instead, having fixed decorrelators with direction-dependent input gains.

Features as described herein do not require decreasing the coherence between loudspeaker channels of multi-channel audio files. Instead, features may comprise decreasing the coherence between resulting headphone channels. Moreover, mono audio files may be used instead of multi-channel audio files. Conventional methods do not take head tracking into account and, thus, direct interpolation would be required in the case of head tracking. Features as described herein, on the other hand, provide an example system and method to take the head tracking into account, and to avoid interpolation by having the fixed decorrelators.

In one type of conventional system, the aim is to extract multiple auditory objects from a stereo downmix and to render all these objects with headphones. Decorrelation is needed in this context in case there are more independent components in the same time-frequency tile than there are downmix signals. In this case the decorrelator creates incoherence to reflect the perception of multiple independent sources. Features as described herein does not need to include this kind of processing. It simply aims to render single audio signals by decreasing the resulting inter-aural coherence in order to enhance externalization. Features as described herein also use multiple decorrelators, and each output is convolved with a dedicated HRTF. Each auditory object may be processed separately. These features create a better perception of envelopment, and the decorrelated signal path has a perceivable direction. These properties yield a perception of higher audio quality.

An example method comprises providing an input audio signal in a first path and convolving with an interpolated first head-related transfer function (HRTF) based upon a direction; providing the input audio signal in a second path, where the second path comprises a plurality of branches comprising respective decorrelators in each branch and an amplifier in each branch adjusted based upon the direction, and applying to a respective output from each of the decorrelators respective second head-related transfer functions (HRTF); and combining outputs from the first and second paths to form a left output signal and a right output signal.

The method may further comprise selecting a first gain to be applied to the input audio signal at a start of the first path and a second gain to be applied to the input audio signal at a start of the second path based upon a desired externalization. The method may further comprise selecting respective different gains to be applied to the input audio signal before the decorrelators. The respective different gains may be selected based, at least partially, upon the direction. The decorrelators may be static decorrelators and where the second head-related transfer function (HRTF) are static HRTF. Outputs from the first path may comprise a left output signal and a right output signal from the first head-related transfer function (HRTF), and where the outputs from the second path comprise a left output signal and a right output signal from each of the second head-related transfer functions (HRTF).

An example apparatus may comprise a first audio signal path comprising an interpolated first head-related transfer function (HRTF) configured to convolute the input audio signal based upon a direction; a second audio signal path comprising a plurality of branches, each branch comprising: an adjustable amplifier configured to be adjusted based upon the direction; a decorrelator, and a respective second head-related transfer function (HRTF), where the apparatus is configured to combine outputs from the first and second paths to form a left output signal and a right output signal.

The first audio signal path may comprise a first variable amplifier before the first head-related transfer function (HRTF), where the second audio signal path comprises a second variable amplifier before the decorrelators, and the apparatus comprises an adjuster to adjust a desired externalization by based upon adjusting the first and second variable amplifiers. The apparatus may further comprise a selector connected to the adjustable amplifiers, where the adjuster is configured to adjust the adjustable amplifiers based, at least partially, upon the direction. The decorrelators may be static decorrelators and where the second head-related transfer function (HRTF) are static HRTF. The first head-related transfer function (HRTF) may be configured to generate a first path left output signal and a first path right output signal, and where each of the second head-related transfer functions (HRTF) are configured to generate a second path left output signal and a second path right output signal.

An example non-transitory program storage device may be provided, such as memory 24 for example, readable by a machine, tangibly embodying a program of instructions executable by the machine for performing operations, the operations comprising controlling, at least partially, first outputs from a first audio signal path from an input audio signal comprising convolving with an interpolated first head-related transfer function (HRTF) based upon a direction; controlling, at least partially, second outputs from a second audio signal path from the same input audio signal, where the second audio signal path comprises branches, comprising amplifying the input audio signal in each branch based upon the direction, decorrelating by a decorrelator and applying to a respective output from each of the decorrelators a respective second head-related transfer function (HRTF) filtering; and combining the outputs from the first and second audio signal paths to form a left output signal and a right output signal.

The operations may further comprise selecting a first gain to be applied to the input audio signal at a start of the first path and a second gain to be applied to the input audio signal at a start of the second path based upon a desired externalization. The operations may further comprise selecting respective different gains to be applied to the input audio signal before the decorrelators. The respective second head-related transfer function (HRTF) filtering may comprise use of static head-related transfer function (HRTF) filters. The operations may further comprise outputs from the first path comprising a left first path output signal and a right first path output signal from the first head-related transfer function (HRTF), and where the outputs from the second path comprise a left second path output signal and a right second path output signal from each of the second head-related transfer function (HRTF) filtering.

Any combination of one or more computer readable medium(s) may be utilized as the memory. The computer readable medium may be a computer readable signal medium or a non-transitory computer readable storage medium. A non-transitory computer readable storage medium does not include propagating signals and may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

An example apparatus may be provided comprising means for providing an input audio signal in a first path and applying an interpolated head-related transfer function (HRTF) pair based upon a direction to generate direction dependent first left and right signals in the first path as indicated by block 80; means for providing the input audio signal in a second path as indicated by block 82, where the second path comprises a plurality of filters and a respective adjustable amplifier for each filter, where the amplifiers are configured to be adjusted based upon the direction, and means for applying to an output from each of the filters a respective head-related transfer function (HRTF) pair to generate direction dependent second left and right signals for each filter in the second path; and combining the generated left signals from the first and second paths as indicated by block 84 to form a left output signal for a sound reproduction, and combining the generated right signals from the first and second paths to form a right output signal for the sound reproduction.

In one example embodiment, for the dry path shown in FIG. 3, there a HRTF database may be provided containing 36 HRTF pairs. Using the HRTF database and the direction of arrival, the method may create one interpolated HRTF pair (such as using Vector Base Amplitude Panning (VBAP) so it is a weighted sum of three HRTF pairs selected by the VBAP algorithm). The input signal may be convolved with this one interpolated HRTF pair. For the wet path, there another HRTF database may be provided containing 12 HRTF pairs. These HRTF pairs are fixed to the different branches of the wet path (i.e., HRTF1, HRTF2, . . . , HRTF12). For this example embodiment the input signal is always convolved with all these HRTF pairs after the gains and the decorrelators. The HRTF database of the wet path may be a subset of the HRTF database of the dry path in order to avoid having multiple databases. However, from the algorithm point of view, it could equally well be a completely different database.

In the examples described above, HRTF pairs have been mentioned. It is a transfer function which is transformed from head related impulse responses (HRIRs). Direction dependent impulse response measurements for each ear can be obtained on an individual or using a dummy head for example. A database can be formed with HRTFs, as also mentioned above. In alternative embodiments, one could introduce localization cues rather than introducing the entire HRTF pairs. These localization cues can be extracted from respective HRTF pairs. Put another way, an HRTF pair can possess these direction dependent localization cues already. So, the method could process input signals to introduce desired directionalities in order to simulate the effect of HRTF pairs. A mapping table could contain these localization cues as a function of direction. The method may be used with "simplified" HRTFs containing only the localization cues, such as interaural time difference (ITD) and interaural intensity difference (ILD). Thus, HRTFs referred to herein may comprises these "simplified" HRTFs. Adding ITD and frequency-dependent ILD is a form of HRTF filtering, although a very simple form. Related to the HRTF pairs, these HRTFs may be obtained using measurements by measuring right and left ear impulse responses as a function of sound source position relative to the head position where direction dependent HRTF pairs are obtained from measurements. The HRTF pairs may be obtained by numerical models (simulations). Simulated HRIR or HRTF pairs would work equally well as the measured ones. Simulated HRIR or HRTF pairs might even be better due to absence of the potential measurement noise and errors.

FIG. 3 presents an example implementation using a block diagram for simplicity. The first and second path (dry and wet) are basically trying to form respective ear signals for sound reproduction. The functionality of the blocks shown in FIG. 3 could be drawn in other ways. Basically the exact shape of FIG. 3 is not essential for the method/functionality. This would have one interpolation (or panning) computation and two convolutions for the dry path, and 12 decorrelations and 24 convolutions for the wet path. And in the end, all 13 signals would summed from the left ear and all 13 signals would be summed for the right ear. In the case of multiple simultaneous sources (e.g., 10), other kinds of implementations can be more efficient. One example implementation has fixed HRTFs. The dry signal path (using VBAP) may create three weighted signals with routing to HRTF pairs computed with VBAP. This process is repeated for all sources. The wet signal path creates 12 weighted signals. This process is repeated for each source and the signals are summed together. The decorrelation can be applied once to all signals (i.e., decorrelations). In the end, the dry and the wet signals from all the sources are summed together for the corresponding HRTF and convolved with corresponding HRTF pairs. Thus, the HRTF filtering is performed only once (but potentially for many HRTF pairs if the sources are at different directions).

It should be noted that the output of both implementations described above would be identical. In which order one performs different operations affects the computation efficiency, but the output is the same. The operations (convolution, sum, and multiplication) are linear, so they can be freely rearranged without changing the output.

In virtual-reality (VR) applications, the sound is typically reproduced using headphones, and the video is reproduced using a head-mounted display. As the video is seen by only one individual at a time, it makes sense that also the audio be heard by only that individual. In addition, as VR content may have visual and auditory content all around the subject, a loudspeaker reproduction would require setups with large number of loudspeakers. Thus, headphones are the logical option for spatial-sound reproduction in such applications.

Spatial audio is often delivered in multi-channel format (such as 5.1 or 7.1 audio). Features as described herein my render these signals using headphones so that they are perceived as if they were reproduced in a good listening room with a corresponding loudspeaker setup. The input to the system may be the multi-channel audio signals, the corresponding loudspeaker directions, and the head-orientation information. The head orientation may be obtained automatically from the head-mounted display. The loudspeaker setup is often available in the metadata of the audio file, or it can be pre-defined.

Figure 6:
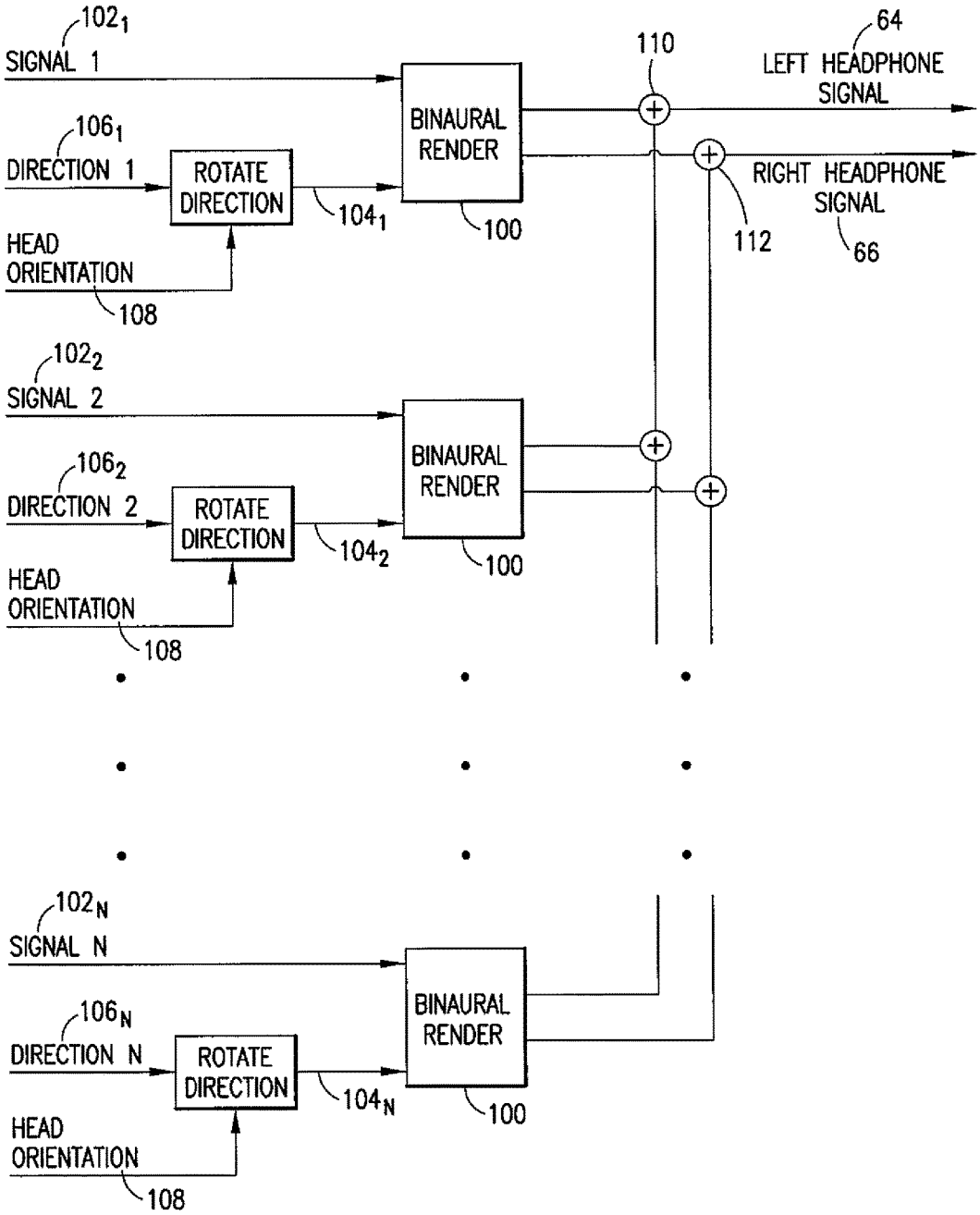
FIG. 6 is a diagram illustrating another example.

Referring also to FIG. 6, an example for rendering multi-channel audio files, such as for VR for example, is shown. Each loadspeaker signal (1, 2, . . . N) has a binaural renderer 100. Each binaural renderer 100 may be as shown in FIG. 3 for example. Thus, FIG. 6 illustrates an embodiment having plurality of the devices shown in FIG. 3. The input to each binaural renderer 100 includes the respective audio signal $\mathbf{102}_1$, $\mathbf{102}_2$, . . . $\mathbf{102}_N$, and a rotational direction signal $\mathbf{104}_1$, $\mathbf{104}_2$, . . . $\mathbf{104}_N$. The rotational direction signals $\mathbf{104}_1$, $\mathbf{104}_2$, . . . $\mathbf{104}_N$ are determined based upon a channel direction signal $106_1$, $106_2$, . . . $106_N$ and a head direction signal 108. The left and right outputs from the binaural renderers 100 are summed at 110 and 112 to form the left headphone signal 64 and the right headphone signal 66.

Features as described herein may be used to position each audio signal of the multi-channel file to the channel direction similar to determined by the loudspeaker setup. Moreover, when the subject rotates her/his head, these directions may be rotated accordingly in order to keep them in the same positions in the world coordinate system. The auditory objects may also be positioned to suitable distances. When these features of auditory reproduction are combined with head-tracked stereoscopic visual reproduction, the result is very natural perception of the reproduced world around. The output of the system is an audio signal for each channel of the headphones. These two signals can be reproduced with normal headphones.

Also, other use cases can easily be derived for the present invention in the VR context. For example, features could be used for positioning auditory objects to arbitrary directions and distances in real time. The directions and the distances could be obtained from the VR rendering engine.

Figure 5:
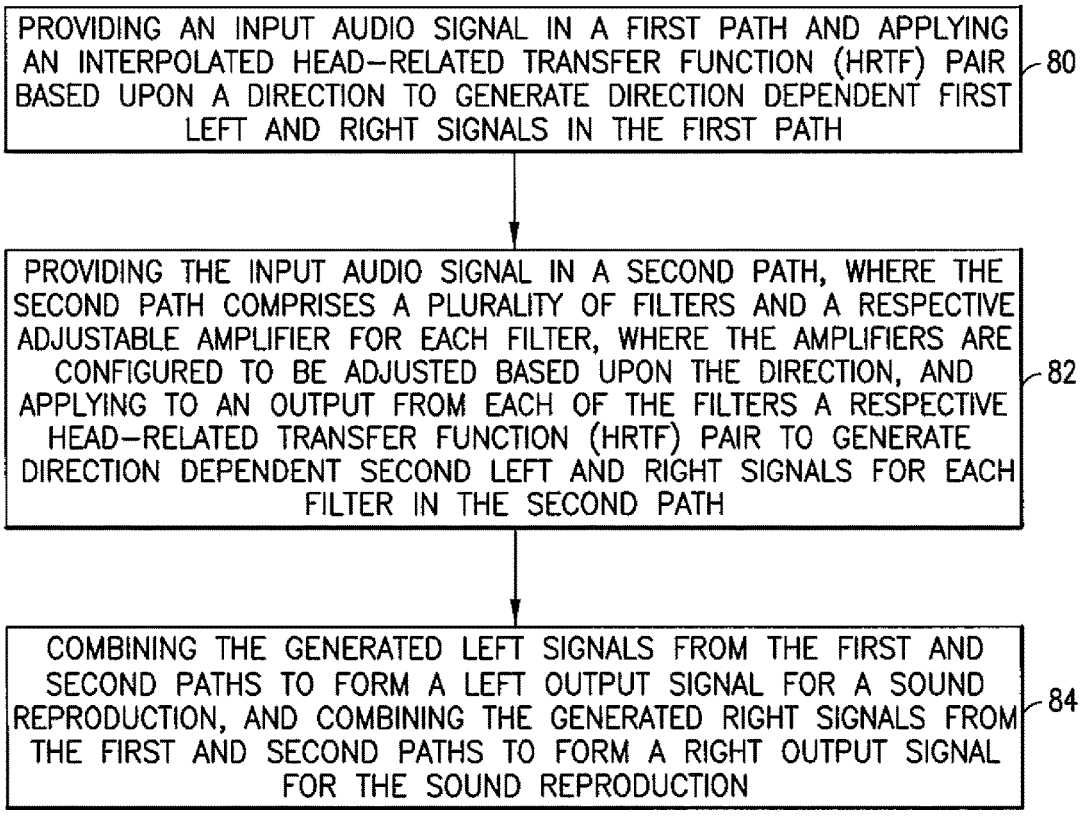
FIG. 5 is a diagram illustrating an example method.

Referring also to FIG. 5, an example method may comprise providing an input audio signal in a first path and applying an interpolated head-related transfer function (HRTF) pair based upon a direction to generate direction dependent first left and right signals in the first path as indicated by block 80; providing the input audio signal in a second path as indicated by block 82, where the second path comprises a plurality of filters and a respective adjustable amplifier for each filter, where the amplifiers are configured to be adjusted based upon the direction, and applying to an output from each of the filters a respective head-related transfer function (HRTF) pair to generate direction dependent second left and right signals for each filter in the second path; and combining the generated left signals from the first and second paths as indicated by block 84 to form a left output signal for a sound reproduction, and combining the generated right signals from the first and second paths to form a right output signal for the sound reproduction.

The method may further comprise selecting respective different gains to be applied by the amplifiers to the input audio signal before the filters. The filters may be static decorrelators and the head-related transfer functions (HRTF) pairs of the second path may be static HRTF pairs. The method may further comprise setting the adjustable amplifiers in the second path at different settings relative to one another based upon the direction. Applying the interpolated head-related transfer function (HRTF) pair to the input audio signal in the first path may comprise convolving the interpolated head-related transfer function (HRTF) pair to the input audio signal in the first path based upon the direction. The method may be applied to a plurality of respective multi-channel audio signals as shown in FIG. 6 as the input audio signal at a same time, and where a plurality of left signals and right signals from the respective multi-channel audio signals are combined for the sound reproduction.

An example apparatus may comprise a first audio signal path comprising an interpolated head-related transfer function (HRTF) pair applied to an input audio signal based upon a direction configured to generate direction dependent first left and right signals in the first path; a second audio signal path comprising a plurality of: an adjustable amplifier configured to be adjusted based upon the direction; a filter for each adjustable amplifier, and a respective head-related transfer function (HRTF) pair applied to an output from the filter, where the second path is configured to generate direction dependent second left and right signals for each filter in the second path, and where the apparatus is configured to combine the generated left signals from the first and second paths to form a left output signal for a sound reproduction, and to combine the generated right signals from the first and second paths to form a right output signal for the sound reproduction.

The apparatus may further comprise a selector connected to the adjustable amplifiers, where the adjuster is configured to adjust the adjustable amplifiers to different respective settings based, at least partially, upon the direction. The filters may be static decorrelators and where the head-related transfer function (HRTF) pairs of the second audio signal path are static. The first audio signal path may be configured to convolve the interpolated head-related transfer function (HRTF) pair to the input audio signal based upon the direction. The apparatus comprises a plurality of pairs of the first and second paths as illustrated by FIG. 6, and where the apparatus is configured to apply a respective multi-channel audio signal to a respective one of the pairs of the first and second paths as the input audio signal at a same time, and where a plurality of left signals and right signals from the respective multi-channel signals are combined for the sound reproduction.

An example apparatus may be provided in a non-transitory program storage device readable by a machine, tangibly embodying a program of instructions executable by the machine for performing operations, the operations comprising: controlling, at least partially, a first audio signal path for an input audio signal comprising applying an interpolated head-related transfer function (HRTF) pair based upon a direction to generate direction dependent first left and right signals in the first path; controlling, at least partially, a second audio signal path for the same input audio signal, where the second audio signal path comprises adjustable amplifiers configured to be set based upon the direction, applying outputs from the amplifiers to respective filters for each of the amplifiers and applying to an output from each of the filters a respective head-related transfer function (HRTF) pair to generate direction dependent second left and right signals for each filter in the second path; and combining the generated left signals from the first and second paths to form a left output signal for a sound reproduction, and combining the generated right signals from the first and second paths to form a right output signal for the sound reproduction.

Features as described above have been primarily described with regard to headset sound reproduction. However, features could also to used for non-headset reproduction including loudspeaker playback for example. A feature of the method as described herein is to avoid the interpolation artifacts when the head of a user is rotated. In the case of the loudspeaker playback that is not an issue since there is no head tracking in loudspeaker playback, but there is no reason why it could not be applied to the loudspeaker playback. Thus, the method can be easily adapted to loudspeaker playback. The interpolated HRTFs (in the dry path) may be replaced by loudspeaker-based positioning (such as amplitude panning, ambisonics, or wave-field synthesis), and the fixed HRTFs (in the wet path) may be replaced by actual loudspeakers.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. A method comprising:

providing an input audio signal in a first path and applying an interpolated head-related transfer function (HRTF) pair based upon a direction to generate direction dependent first left and right signals in the first path;

providing the input audio signal in a second path, where the second path comprises a plurality of filters and a respective adjustable amplifier for each filter, where the plurality of filters comprise decorrelators, where the amplifiers are configured to be adjusted based upon the direction, and applying to an output from each of the filters a respective head-related transfer function (HRTF) pair to generate direction dependent second left and right signals for each filter in the second path; and combining the generated left signals from the first and second paths to form a left output signal for a sound reproduction, and combining the generated right signals from the first and second paths to form a right output signal for the sound reproduction.

2. A method as in claim 1 further comprising, based upon a desired externalization, selecting a first gain to be applied to the input audio signal at a start of the first path and a second gain to be applied to the input audio signal at a start of the second path.

3. A method as in claim 1 further comprising selecting respective different gains to be applied by the amplifiers to the input audio signal before the filters.

4. A method as in claim 3 where the respective different gains are selected based, at least partially, upon the direction.

5. A method as in claim 1 where the decorrelators are static decorrelators and where the head-related transfer functions (HRTF) pairs of the second path are static HRTF pairs.

6. A method as in claim 1 further comprising setting the adjustable amplifiers in the second path at different settings relative to one another based upon the direction.

7. A method as in claim 1 where applying the interpolated head-related transfer function (HRTF) pair to the input audio signal in the first path comprising convolving the interpolated head-related transfer function (HRTF) pair to the input audio signal in the first path based upon the direction.

8. A method as in claim 1 where the method is applied to a plurality of respective audio signals as the input audio signal at a same time, and where a plurality of left signals and right signals from the respective audio signals are combined for the sound reproduction.

9. A method as in claim 1 where providing the input audio signal in a first path comprises the first path not having the decorrelators.

10. An apparatus comprising:

a first audio signal path comprising an interpolated head-related transfer function (HRTF) pair applied to an input audio signal based upon a direction configured to generate direction dependent first left and right signals in the first path;

a second audio signal path comprising a plurality of:

an adjustable amplifier configured to be adjusted based upon the direction;

a filter for each adjustable amplifier, where the filter comprises a decorrelator, and a respective head-related transfer function (HRTF) pair applied to an output from the filter, where the second path is configured to generate direction dependent second left and right signals for each filter in the second path, and where the apparatus is configured to combine the generated left signals from the first and second paths to form a left output signal for a sound reproduction, and to combine the generated right signals from the first and second paths to form a right output signal for the sound reproduction.

11. An apparatus as in claim 10 where the first audio signal path comprises a first variable amplifier before the interpolated head-related transfer function (HRTF) pair, where the second audio signal path comprises a second variable amplifier before the filters, and the apparatus comprises an adjuster to adjust a desired externalization based upon adjusting the first and second variable amplifiers.

12. An apparatus as in claim 11 further comprising a selector connected to the adjustable amplifiers, where the adjuster is configured to adjust the adjustable amplifiers to different respective settings based, at least partially, upon the direction.

13. An apparatus as in claim 10 where the decorrelators are static decorrelators and where the head-related transfer function (HRTF) pairs of the second audio signal path are static.

14. An apparatus as in claim 10 where the first audio signal path is configured to convolve the interpolated head-related transfer function (HRTF) pair to the input audio signal based upon the direction.

15. An apparatus as in claim 10 where the apparatus comprises a plurality of pairs of the first and second paths, and where the apparatus is configured to apply a respective multi-channel audio signal to a respective one of the pairs of the first and second paths as the input audio signal at a same time, and where a plurality of left signals and right signals from the respective multi-channel signals are combined for the sound reproduction.

16. An apparatus as in claim 10 where the first audio signal path does not comprise the decorrelators.

17. A non-transitory program storage device readable by a machine, tangibly embodying a program of instructions executable by the machine for performing operations, the operations comprising:

controlling, at least partially, a first audio signal path for an input audio signal comprising applying an interpolated head-related transfer function (HRTF) pair based upon a direction to generate direction dependent first left and right signals in the first path;

controlling, at least partially, a second audio signal path for the same input audio signal, where the second audio signal path comprises adjustable amplifiers configured to be set based upon the direction, applying outputs from the amplifiers to respective filters for each of the amplifiers, where the filters comprise decorrelators, and applying to an output from each of the filters a respective head-related transfer function (HRTF) pair to generate direction dependent second left and right signals for each filter in the second path; and combining the generated left signals from the first and second paths to form a left output signal for a sound reproduction, and combining the generated right signals from the first and second paths to form a right output signal for the sound reproduction.

18. A non-transitory program storage device as in claim 17 where the operations further comprise, based upon a desired externalization, selecting a first gain to be applied to the input audio signal at a start of the first path and a second gain to be applied to the input audio signal at a start of the second path.

19. A non-transitory program storage device as in claim 17 where the operations further comprise selecting respective different gains to be applied to the input audio signal by the amplifiers before the decorrelators.

20. A non-transitory program storage device as in claim 17 where the respective head-related transfer function (HRTF) pair comprises use of static head-related transfer function (HRTF) filters.

21. A non-transitory program storage device as in claim 20 where the operations further comprise outputs from the first path comprising a left first path output signal and a right first path output signal from the interpolated head-related transfer function (HRTF) pair, and where the outputs from the second path comprise a left second path output signal and a right second path output signal from each of the respective head-related transfer function (HRTF) pair.

22. A non-transitory program storage device as in claim 17 where the operations further comprises the input audio signal comprising a plurality of respective multi-channel signals being controlled at a same time, and where a plurality of left signals and right signals from the respective multi-channel signals are combined for the sound reproduction.

* * * * *